US008172116B1

(12) United States Patent
Lehan et al.

(10) Patent No.: US 8,172,116 B1
(45) Date of Patent: May 8, 2012

(54) CHILD CARRIER HAVING ADAPTIVE LEG SUPPORTS

(76) Inventors: Lisbeth Hals Lehan, Niwot, CO (US); Stephen Boyer Lehan, Niwot, CO (US)

( * ) Notice: Subject to any disclaimer, the term of this patent is extended or adjusted under 35 U.S.C. 154(b) by 953 days.

(21) Appl. No.: 12/220,765

(22) Filed: Jul. 28, 2008

(51) Int. Cl.

| | |
|---|---|
| ***A61G 1/00*** | (2006.01) |
| ***A45F 3/14*** | (2006.01) |
| ***A45F 3/04*** | (2006.01) |
| ***A45F 3/08*** | (2006.01) |

(52) U.S. Cl. ..... 224/160; 224/159

(58) Field of Classification Search ..... 224/160, 224/159, 158, 161, 257, 258, 259, 262
See application file for complete search history.

(56) References Cited

U.S. PATENT DOCUMENTS

| | | | | | |
|---|---|---|---|---|---|
| 3,481,517 | A * | 12/1969 | Aukerman | 224/160 |
| 3,587,952 | A * | 6/1971 | Higuchi | 224/160 |
| 4,009,808 | A * | 3/1977 | Sharp | 224/160 |
| 4,234,229 | A * | 11/1980 | Arnold | 297/467 |
| 4,428,514 | A * | 1/1984 | Elf | 224/579 |
| 4,434,920 | A * | 3/1984 | Moore | 224/160 |
| 4,492,326 | A * | 1/1985 | Storm | 224/160 |
| 4,579,264 | A * | 4/1986 | Napolitano | 224/160 |
| 4,724,988 | A * | 2/1988 | Tucker | 224/160 |
| 4,986,458 | A * | 1/1991 | Linday | 224/160 |
| 5,246,152 | A * | 9/1993 | Dotseth | 224/159 |
| 5,813,580 | A * | 9/1998 | Fair | 224/160 |
| 6,415,969 | B1 * | 7/2002 | Higuchi | 224/160 |
| 6,715,651 | B2 * | 4/2004 | Le Gal | 224/160 |
| 2005/0051582 | A1 * | 3/2005 | Frost | 224/160 |

* cited by examiner

*Primary Examiner* — Justin Larson
*Assistant Examiner* — Lester L Vanterpool
(74) *Attorney, Agent, or Firm* — Tobey & Associates, LLC; Morley C. Tobey, Jr.

(57) ABSTRACT

A carrier for transporting a child by a transporting individual. The carrier includes a torso support part configured for supporting the torso of the child, a seat support part coupled to the torso support part, and at least one strap coupled to the torso support part and/or to the seat support part and with the torso support part and the seat support part configured to encircle at least part of the torso of the transporting individual. The seat support part is configured for supporting the posterior of the child in a sitting position in a first configuration, and the seat support part is configured for supporting the posterior of the child in a hanging position in a second configuration.

26 Claims, 15 Drawing Sheets

CHILD CARRIER HAVING ADAPTIVE LEG SUPPORTS

BACKGROUND

Various infant carriers have been and are currently available for transporting a child by a parent or other individual. Each of the infant carriers is designed for a limited carrying mode, i.e., on the back, the front, or the hip of the parent. Each is also designed for a limited age, limited weight, and limited size of child to be carried in the carrier. The carriers available range from soft, light-weight carriers that snuggle the child to the front of the parent to larger carriers having metal frames intended for carrying the child on the parent's back.

BRIEF DESCRIPTION OF THE DRAWINGS

The accompanying drawings provide visual representations which will be used to more fully describe various representative embodiments and can be used by those skilled in the art to better understand the representative embodiments disclosed and their inherent advantages. In these drawings, like reference numerals identify corresponding elements.

DETAILED DESCRIPTION

Figure 1:
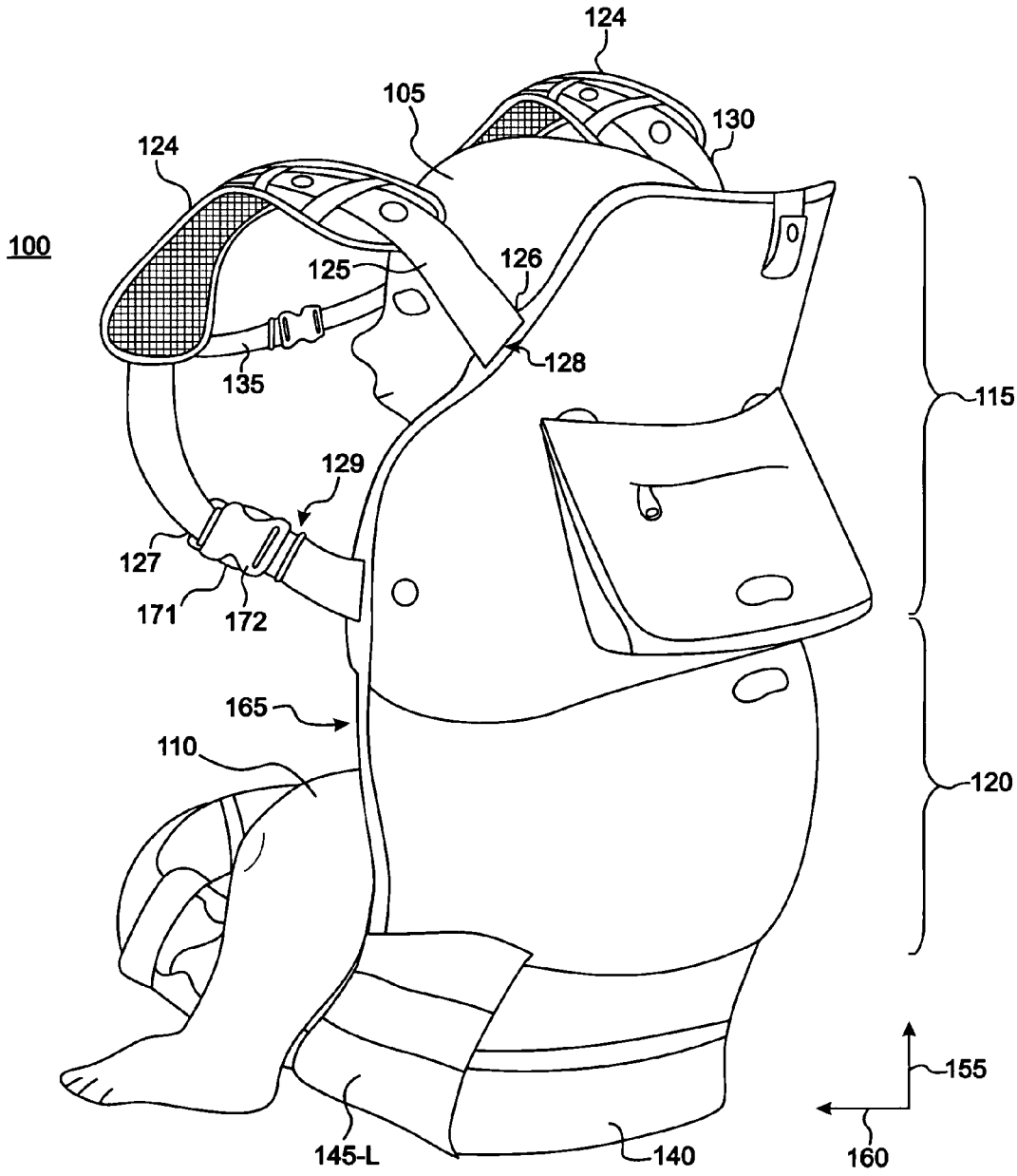
FIG. 1 is a drawing of a child carrier with an outline of a child in the child carrier with the upper legs of the child supported as described in various representative embodiments.

As shown in the drawings for purposes of illustration, novel child carriers are disclosed herein that enable carrying the child in various positions including on the back, on the hip, and in front of an individual. In various configurations, the upper legs or thighs of the child can be supported proximately perpendicular to the body of the child. And in other configurations, the thighs of the child can hang proximately parallel to the body of the child. Dependent upon the size and weight of the child, the individual may find it more comfortable to carry the child in one of these configurations than in the others and/or the child may be more comfortable in one of these configurations than in the others. Previous carriers have been restricted in the configurations available for carrying the child.

In the following disclosure, when a child is described as being in a child carrier in a sitting position, a proximate sitting position, or an ergonomic sitting position, the thighs of the child are supported proximately perpendicular to the child's body with that part of the child's legs below his/her knees hanging generally downward. As used herein, the upper part of the child's legs means the child's thighs. When the child is described as being in the child carrier in a hanging position, the thighs of the child are for the most part unsupported with both the upper (thighs) and lower parts of the child's legs generally hanging downward. In the following detailed description and in the several figures of the drawings, like elements are identified with like reference numerals.

FIG. 1 is a drawing of a child carrier 100 with an outline of a child 105 in the child carrier 100 with the upper legs 110 of the child 105 supported as described in various representative embodiments. As referred to herein, the upper legs 110 of the child 105 are the child's thighs 110. The child carrier 100 comprises a torso support part 115, a seat support part 120, a left shoulder strap 125, a right shoulder strap 130, a chest strap 135, and a hip belt 140. The seat support part 120 comprises a left upper-leg-support part 145-L and a right upper-leg-support part 145-R. Upper-leg-support part 145 refers to the left upper-leg-support part 145-L, the right upper-leg-support part 145-R, or to both the left and the right upper-leg-support parts 145-L,145-R. The right upper-leg-support part 145-R is hidden from view in FIG. 1 by the seat support part 120 but is shown in FIG. 3E. A shoulder pad 124 is coupled to each shoulder strap 125,130, wherein each shoulder pad 124 is removable from its associated shoulder strap 125,130 and can be replaced or not replaced as desired.

The torso support part 115 is configured for supporting the back of the child 105 while in the carrier 100. The seat support part 120 is configured for supporting the posterior of the child 105 while in the carrier 100 and is coupled to the torso support part 115. The chest strap 135 can be used to secure the left and the right shoulder straps 125,130 together.

The left shoulder strap 125 has an upper left-strap end 126 and a lower left-strap end 127, and the right shoulder strap 130 has an upper right-strap end 131 and a lower right-strap end 132. The upper left-strap end 126 is coupled to the left side of the torso support part 115 at an upper left coupling point 128 on the torso support part 115; the lower left-strap end 127 is coupled to the left side of the torso support part 115 at a lower left coupling point 129 on the torso support part 115; the upper right-strap end 131 is coupled to the right side of the torso support part 115 at an upper right coupling point 133 on the torso support part 115; and the lower right-strap end 132 is coupled to the right side of the torso support part 115 at a lower right coupling point 134 on the torso support part 115. Neither the upper right-strap end 131, the lower right-strap end 132, the upper right coupling point 133, nor the lower right coupling point 134 are visible in FIG. 1 due to the presence of the torso support part 115 but are symmetrically located to that of respectively the upper left-strap end 126, the lower left-strap end 127, the upper left coupling point 128, and the lower left coupling point 129 and are shown in FIG. 3E. The upper left coupling point 128 is located further from the seat support part 120 than is the lower left coupling point 129, and the upper right coupling point 133 is located further from the seat support part 120 than is the lower right coupling point 134.

The left shoulder strap 125 comprises a first fastener 171 at the lower left-strap end 127; the right shoulder strap 130 comprises a third fastener 173 at the lower right-strap end 132; the torso support part 115 comprises a second fastener 172 at the lower left coupling point 129; and the torso support part 115 comprises a fourth fastener 174 at the lower right coupling point 134. The third fastener 173 and the fourth fastener 174 are hidden from view in FIG. 1 by the seat support part 120. The first fastener 171 and the second fastener 172 are configured such that they can be coupled together resulting in the coupling of the left shoulder strap 125 to the torso support part 115. The third fastener 173 and the fourth fastener 174 are configured such that they can be coupled together resulting in the coupling of the right shoulder strap 130 to the torso support part 115. The first fastener 171 and the third fastener 173 are further configured such that they can be coupled to each other. In a representative embodiment, the first fastener 171 could be a male type fastening device, the second fastener 172 a female type fastening device, the third fastener 173 a female type fastening device, and the fourth fastener 174 a male type fastening device. In another representative embodiment, the first fastener 171 could be a female type fastening device, the second fastener 172 a male type fastening device, the third fastener 173 a male type fastening device, and the fourth fastener 174 a female type fastening device. The left and right shoulder straps 125, 130 are adjustable in length as are other items including, but not necessarily limited to, the chest strap 130 and the hip belt 140.

The left upper-leg-support part 145-L is coupled to the left side of the seat support part 120 and the right upper-leg-support part 145-R is coupled to the right side of the seat support part 120; the seat support part 120 is coupled to the hip belt 140; the left upper-leg-support part 145-L is further configured for detachable coupling to the left side of the hip belt 140, and the right upper-leg-support part 145-R is further configured for detachable coupling to the right side of the hip belt 140. If the left upper-leg-support part 145-L is coupled to the left side of the hip belt 140 and the right upper-leg-support part 145-R is coupled to the right side of the hip belt 140 as shown in FIG. 1, the carrier 100 is configured for supporting the thighs 110 of the child 105 proximately perpendicular to the body 165 of the child 105. In this configuration, the child 105 is in a proximate sitting position. When the child 105 is in the child carrier 100 in a sitting position, a proximate sitting position, or an ergonomic sitting position, the thighs 110 of the child 105 are supported proximately perpendicular to the child's 105 body 165 with that part of the child's 105 legs below his/her knees hanging downward. The body 165 of the child is hidden from view in FIG. 1 due to the presence of the torso support part 115 and the seat support part 120. As will be indicated in the discussion of FIG. 2, if the left upper-leg-support part 145-L is decoupled from the left side of the hip belt 140 and the right upper-leg-support part 145-R is decoupled from the right side of the hip belt 140, the carrier 100 is configured to enable the thighs 110 of the child 105 to hang proximately parallel to the body 165 of the child 105. In this configuration, the child 105 is in a proximate hanging position. When the child 105 is in the child carrier 100 in a hanging position, both the upper and lower part of the child's 105 legs are generally hanging downward. In FIG. 1, a vertical line 155 is proximately parallel to the body 165 of the child 105 and a horizontal line 160 is proximately perpendicular to the body 165 of the child 105.

Figure 2:
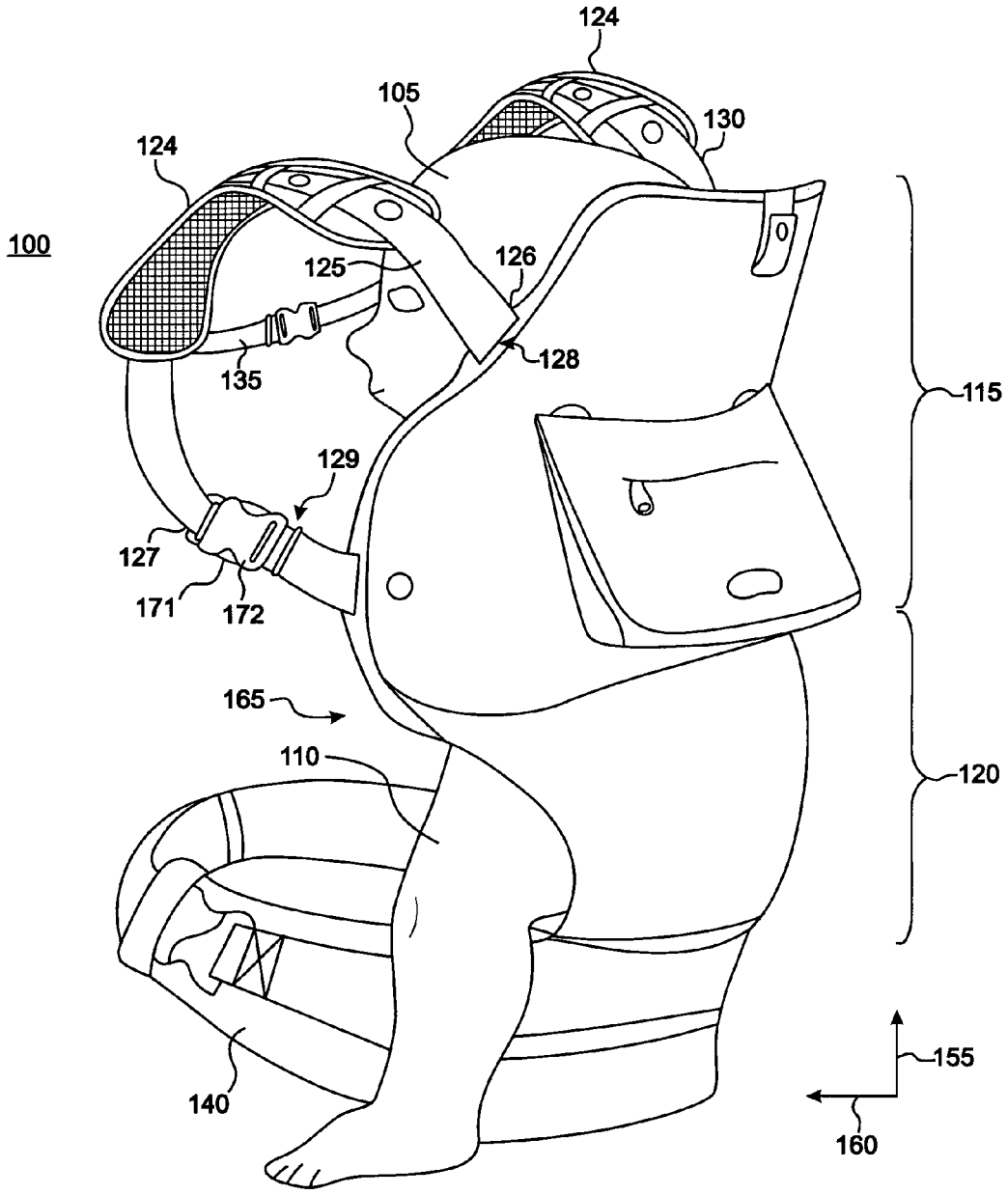
FIG. 2 is a drawing of the child carrier with an outline of a child in the child carrier of FIG. 1 with the upper legs of the child unsupported.

FIG. 2 is a drawing of the child carrier 100 with an outline of a child 105 in the child carrier 100 of FIG. 1 with the upper legs 110 of the child 105 unsupported. Again as referred to herein, the upper legs 110 of the child 105 are the child's thighs 110. The child carrier 100 comprises the torso support part 115, the seat support part 120, the left shoulder strap 125, the right shoulder strap 130, the chest strap 135, and the hip belt 140. The seat support part 120 comprises the left upper-leg-support part 145-L, and the right upper-leg-support part 145-R. As in FIG. 1, the right upper-leg-support part 145-R is hidden from view in FIG. 2 by the seat support part 120 but is shown in FIG. 3E. A shoulder pad 124 is coupled to each shoulder strap 125,130, wherein each shoulder pad 124 is removable from its associated shoulder strap 125,130 and can be replaced or not replaced as desired.

The torso support part 115 is configured for supporting the back of the child 105 while in the carrier 100. The seat support part 120 is configured for supporting the posterior of the child 105 while in the carrier 100 and is coupled to the torso support part 115.

The left shoulder strap 125 has an upper left-strap end 126 and a lower left-strap end 127, and the right shoulder strap 130 has an upper right-strap end 131 and a lower right-strap end 132. The upper left-strap end 126 is coupled to the left side of the torso support part 115 at an upper left coupling point 128 on the torso support part 115; the lower left-strap end 127 is coupled to the left side of the torso support part 115 at a lower left coupling point 129 on the torso support part 115; the upper right-strap end 131 is coupled to the right side of the torso support part 115 at an upper right coupling point 133 on the torso support part 115; and the lower right-strap end 132 is coupled to the right side of the torso support part 115 at a lower right coupling point 134 on the torso support part 115. Neither the upper right-strap end 131, the lower right-strap end 132, the upper right coupling point 133, nor the lower right coupling point 134 are visible in FIG. 2 due to the presence of the torso support part 115 but are symmetrically located to that of respectively the upper left-strap end 126, the lower left-strap end 127, the upper left coupling point 128, and the lower left coupling point 129 and are shown in FIG. 3E. The upper left coupling point 128 is located further from the seat support part 120 than is the lower left coupling point 129, and the upper right coupling point 133 is located further from the seat support part 120 than is the lower right coupling point 134.

The left shoulder strap 125 comprises a first fastener 171 at the lower left-strap end 127; the right shoulder strap 130 comprises a third fastener 173 at the lower right-strap end 132; the torso support part 115 comprises a second fastener 172 at the lower left coupling point 129; and the torso support part 115 comprises a fourth fastener 174 at the lower right coupling point 134. The third fastener 173 and the fourth fastener 174 are hidden from view in FIG. 1 by the seat support part 120. The first fastener 171 and the second fastener 172 are configured such that they can be coupled together resulting in the coupling of the left shoulder strap 125 to the torso support part 115. The third fastener 173 and the fourth fastener 174 are configured such that they can be coupled together resulting in the coupling of the right shoulder strap 130 to the torso support part 115. The first fastener 171 and the third fastener 173 are further configured such that they can be coupled to each other. In a representative embodiment, the first fastener 171 could be a male type fastening device, the second fastener 172 a female type fastening device, the third fastener 173 a female type fastening device, and the fourth fastener 174 a male type fastening device. In another representative embodiment, the first fastener 171 could be a female type fastening device, the second fastener 172 a male type fastening device, the third fastener 173 a male type fastening device, and the fourth fastener 174 a female type fastening device. The left and right shoulder straps 125, 130 are adjustable in length as are other items including, but not necessarily limited to, the chest strap 130 and the hip belt 140.

The left upper-leg-support part 145-L is coupled to the left side of the seat support part 120 and the right upper-leg-support part 145-R is coupled to the right side of the seat support part 120; the seat support part 120 is coupled to the hip belt 140; the left upper-leg-support part 145-L is further configured for detachable coupling to the left side of the hip belt 140, and the right upper-leg-support part 145-R is further configured for detachable coupling to the right side of the hip belt 140. If the left upper-leg-support part 145-L is coupled to the left side of the hip belt 140 and the right upper-leg-support part 145-R is coupled to the right side of the hip belt 140 as shown in FIG. 1, the carrier 100 is configured for supporting the thighs 110 of the child 105 proximately perpendicular to the body 165 of the child 105. In this configuration, the child 105 is in a proximate sitting position. The body 165 of the child is hidden from view in FIG. 1 due to the presence of the torso support part 115 and the seat support part 120. As shown in FIG. 2, if the left upper-leg-support part 145-L is decoupled from the left side of the hip belt 140 and the right upper-leg-support part 145-R is decoupled from the right side of the hip belt 140, the carrier 100 is configured to enable the thighs 110 of the child 105 to hang proximately parallel to the body 165 of the child 105. In this configuration, the child 105 is in a proximate hanging position. In FIG. 2, a vertical line 155 is proximately parallel to the body 165 of the child 105 and a horizontal line 160 is proximately perpendicular to the body 165 of the child 105.

Figure 3A:
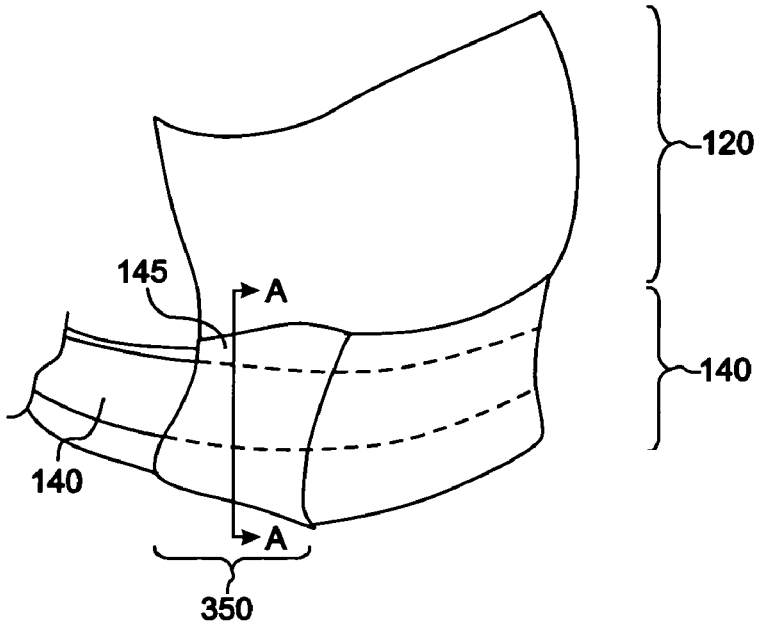
FIG. 3A is a drawing of one of the upper-leg-support parts coupled to the hip belt of the child carrier of FIG. 1.

FIG. 3A is a drawing of one of the upper-leg-support parts 145 coupled to the hip belt 140 of the child carrier 100 of FIG. 1. In FIG. 3A, a portion of the hip belt 140 is passed through a sleeve 350 which provides coupling of the upper-leg-support part 145 to the hip belt 140 and thereby support of one of the upper legs (thighs) 110 of the child 105 when the child 105 is placed in the carrier 100. Both the upper-leg-support part 145 and the hip belt 140 are shown coupled to the seat support part 120 of the carrier 100.

Figure 3B:
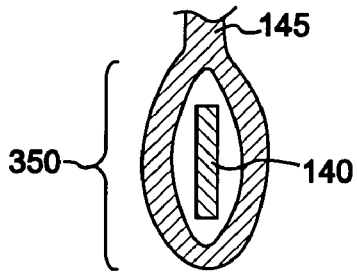
FIG. 3B is a drawing of the upper-leg-support part coupled to the hip belt of the child carrier at cross-section A-A of FIG. 3A.

FIG. 3B is a drawing of the upper-leg-support part 145 coupled to the hip belt 140 of the child carrier 100 at cross-section A-A of FIG. 3A. In FIG. 3B, the hip belt 140 is shown inside the sleeve 350 coupled to the upper-leg-support part 145.

Figure 3C:
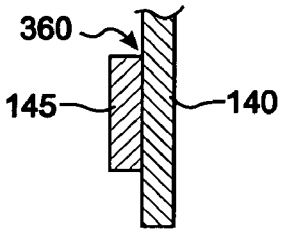
FIG. 3C is a drawing of an alternative embodiment of the coupling of the upper-leg-support part to the hip belt of the child carrier of FIG. 3A.

FIG. 3C is a drawing of an alternative embodiment of the coupling of the upper-leg-support part 145 to the hip belt 140 of the child carrier 100 of FIG. 3A. In FIG. 3C, the upper-leg-support part 145 is coupled to the hip belt 140 via mating areas of a hook and loop type fastener 360 on the upper-leg-support part 145 and the hip belt 140.

Figure 3D:
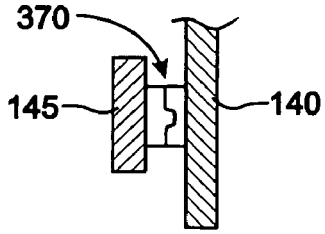
FIG. 3D is a drawing of an alternative embodiment of the coupling of the upper-leg-support part to the hip belt of the child carrier of FIG. 3A.
Figure 3E:
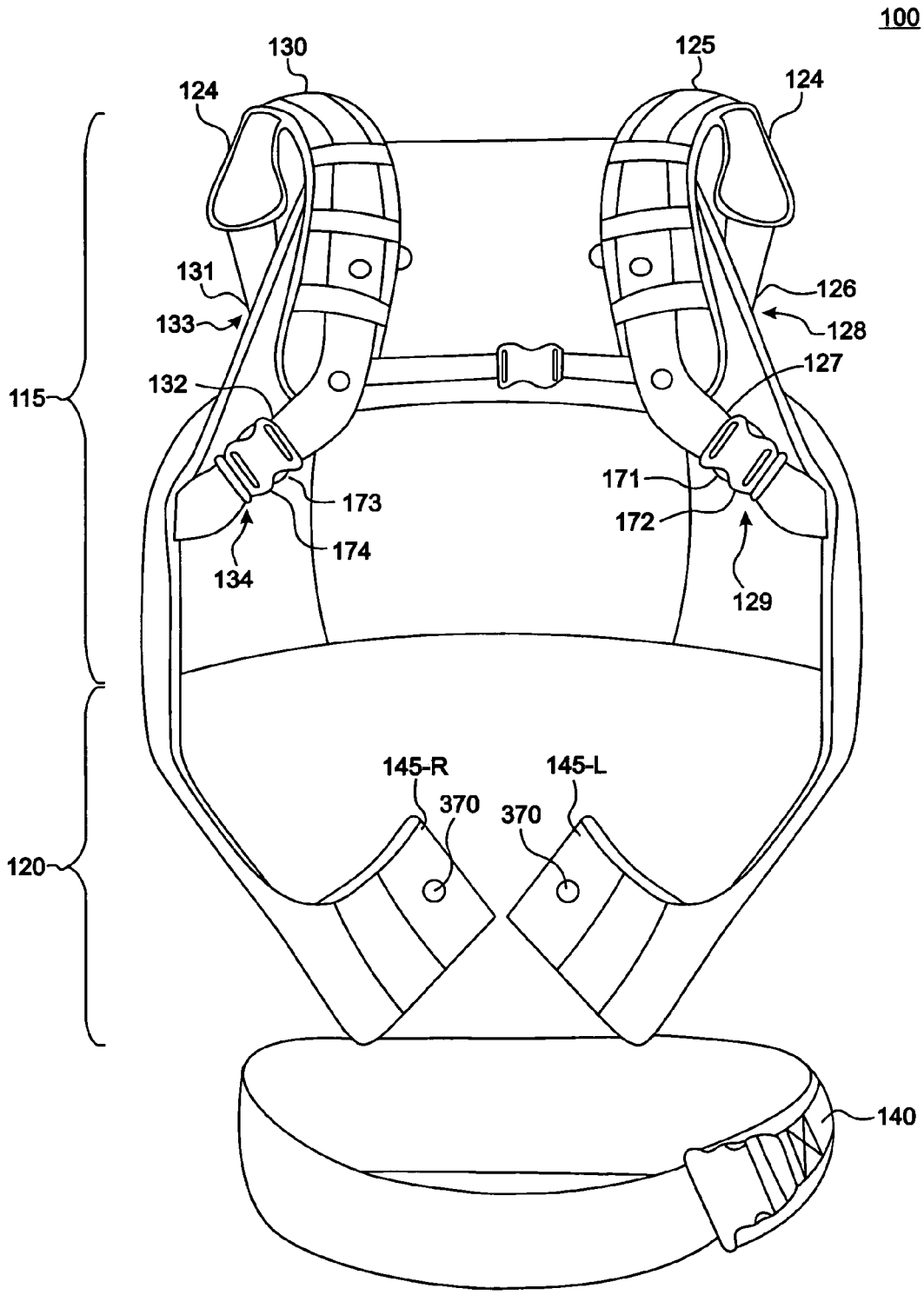
FIG. 3E is a drawing of an inside view of the child carrier of FIG. 1.

FIG. 3D is a drawing of an alternative embodiment of the coupling of the upper-leg-support part 145 to the hip belt 140 of the child carrier 100 FIG. 3A. In FIG. 3D, the upper-leg-support part 145 is coupled to the hip belt 140 via mating snaps 370 on the upper-leg-support part 145 and the hip belt 140.

FIG. 3E is a drawing of an inside view of the child carrier 100 of FIG. 1. In FIG. 3E, left and right upper-leg-support parts 145-L,145-R are shown folded into the inside of the seat support part 120 of the child carrier 100 for storage when not in use in supporting the thighs 110 of the child 105. A pair of mating snaps 370, one on the left upper-leg-support part 145-L and one on the left inside side of the seat support part 120, similar to that shown in FIG. 3D could be used to securely stow the left upper-leg-support part 145-L, and another pair of mating snaps 370, one on the right upper-leg-support part 145-R and one on the right inside side of the seat support part 120 could be used to securely stow the right upper-leg-support part 145-R. Also shown in FIG. 3E are the torso support part 115, the hip belt 140, the left and the right shoulder straps 125,130, the upper and the lower left-strap ends 126,127, the upper and the lower left coupling points 128,129, the upper and the lower right-strap ends 131,132, the upper and the lower right coupling point 133,134, and the first, the second, the third, and the fourth fasteners 171,172, 173,174. As can be seen in FIG. 3E, when the left and right upper-leg-support parts 145-L,145-R are not in use in supporting the thighs 110 of the child 105 a part of the seat support part 120 on both the left and the right sides also may become unavailable for supporting the seat of the child 105.

Figure 4:
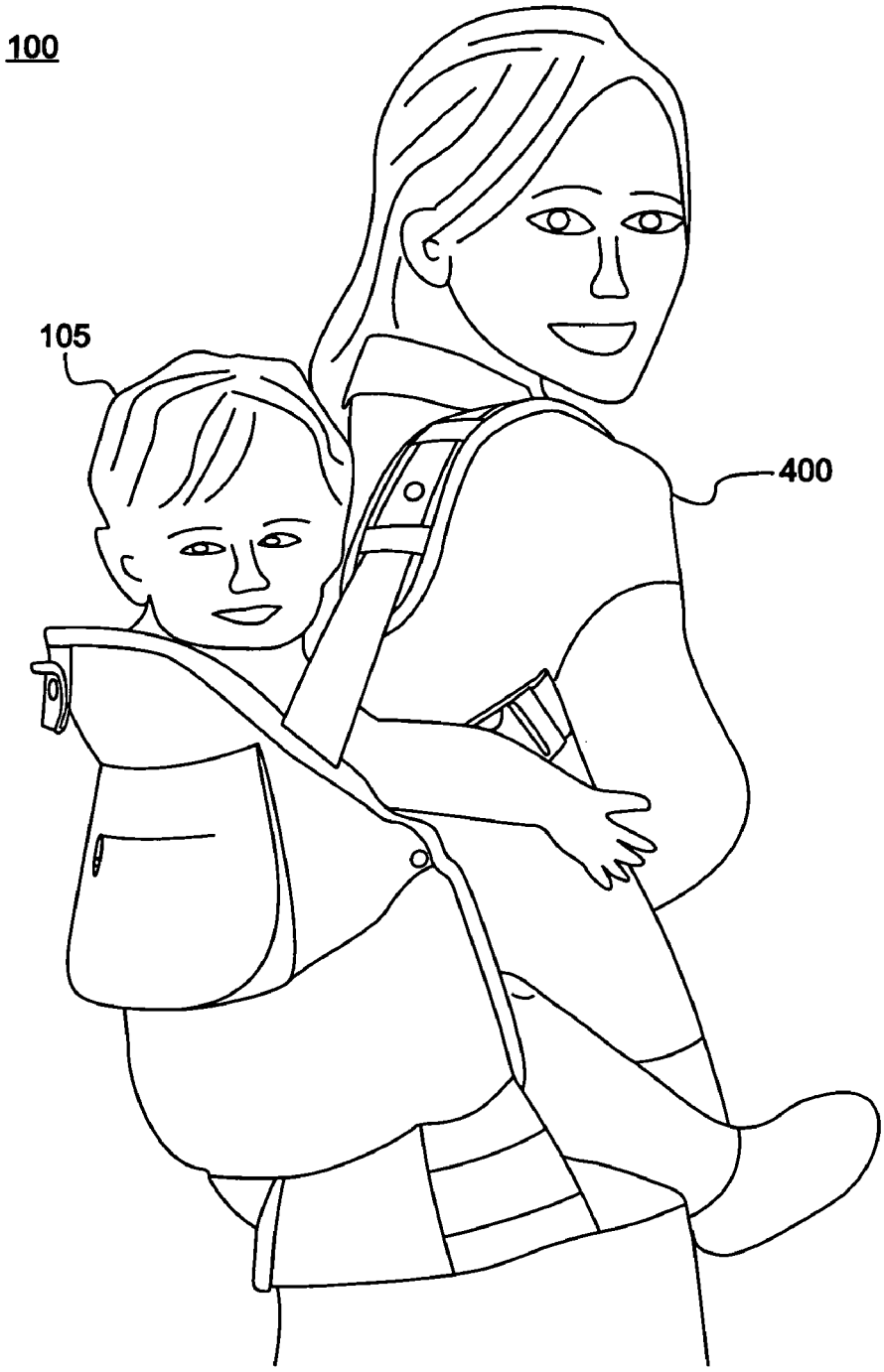
FIG. 4 is a drawing of the child carrier of FIG. 1 with the child carried on the back of a transporting individual, with the child facing toward the transporting individual, and with the child's upper legs (thighs) supported.

FIG. 4 is a drawing of the child carrier 100 of FIG. 1 with the child 105 carried on the back of a transporting individual 400, with the child 105 facing toward the transporting individual 400, and with the child's upper legs (thighs) 110 supported. Neither of the child's 105 upper legs 110 are not visible in FIG. 4.

Figure 5:
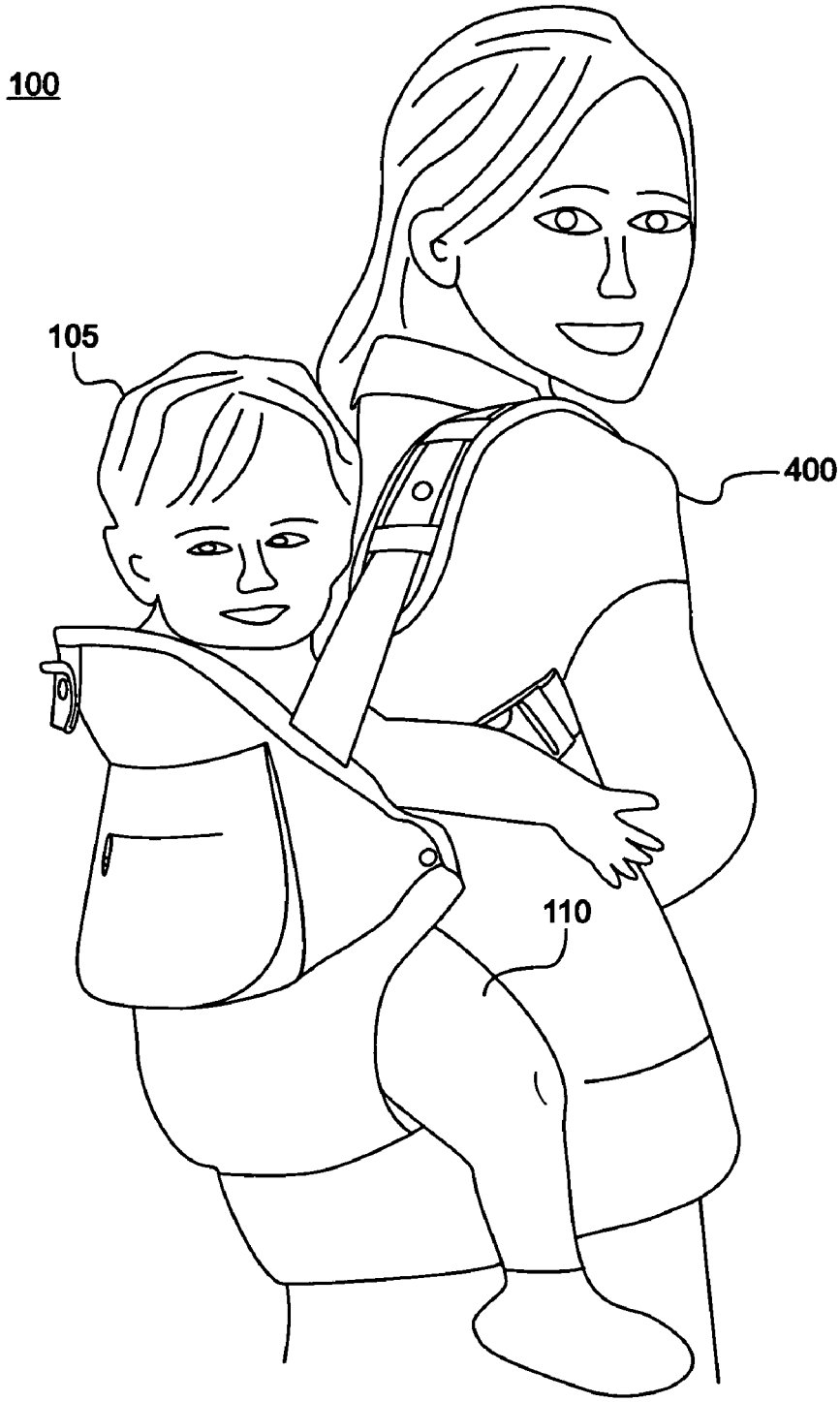
FIG. 5 is a drawing of the child carrier of FIG. 1 with the child carried on the back of the transporting individual, with the child facing the transporting individual, and with the child's upper legs (thighs) unsupported.

FIG. 5 is a drawing of the child carrier 100 of FIG. 1 with the child 105 carried on the back of the transporting individual 400, with the child 105 facing the transporting individual 400, and with the child's upper legs (thighs) 110 unsupported.

Figure 6:
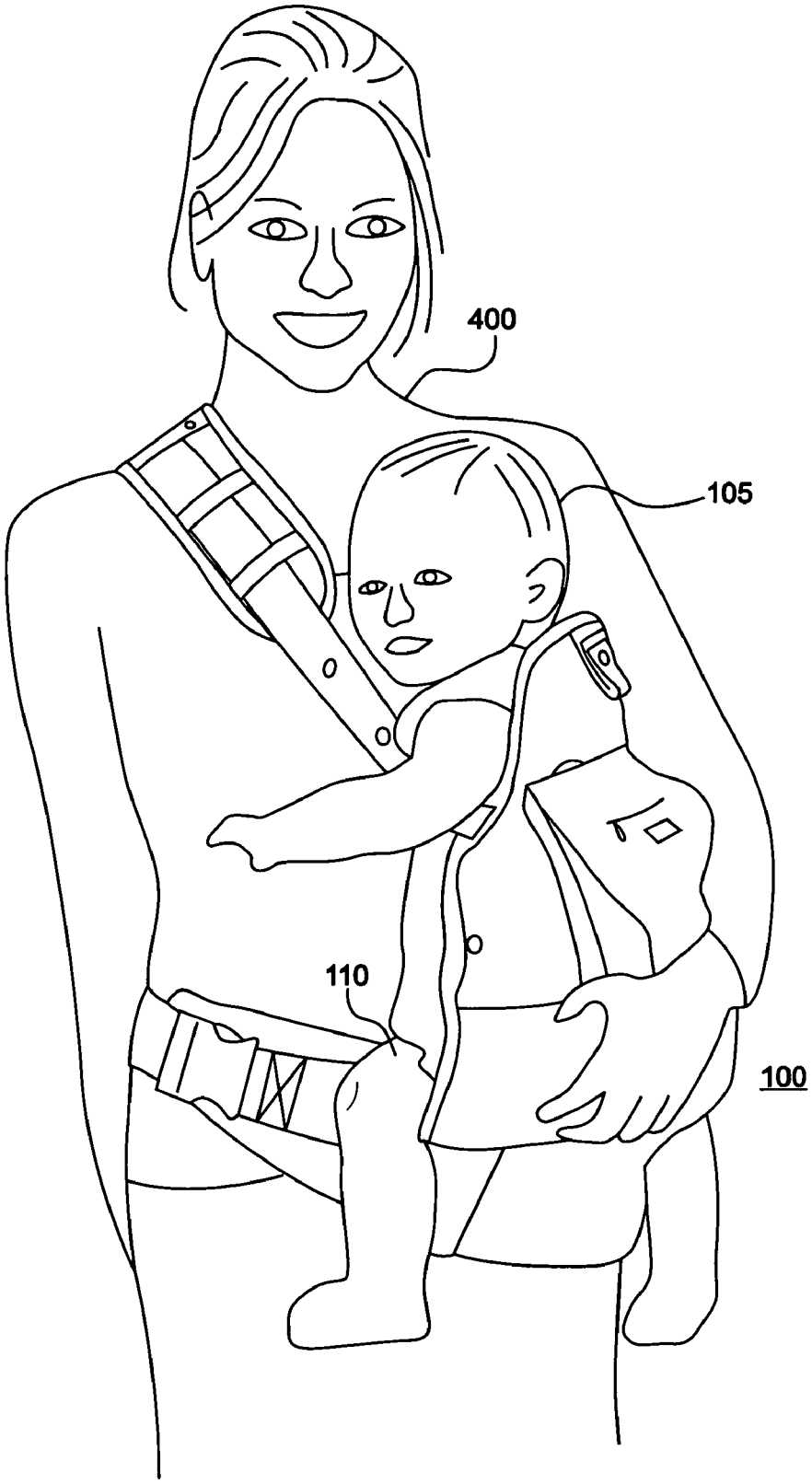
FIG. 6 is a drawing of the child carrier of FIG. 1 with the child carried on the hip of the transporting individual, with the child facing the transporting individual, and with the child's upper legs (thighs) supported.

FIG. 6 is a drawing of the child carrier 100 of FIG. 1 with the child 105 carried on the hip of the transporting individual 400, with the child 105 facing the transporting individual 400, and with the child's upper legs (thighs) 110 supported. In FIG. 6, the first fastener 171 is coupled to the third fastener 173. The first fastener 171 could be a male type fastening device with the third fastener 173 being a female type fastening device, or the first fastener 171 could be a female type fastening device with the third fastener 173 being a male type fastening device. The left and the right shoulder straps 125, 130 can be adjusted in length as appropriate.

Figure 7:
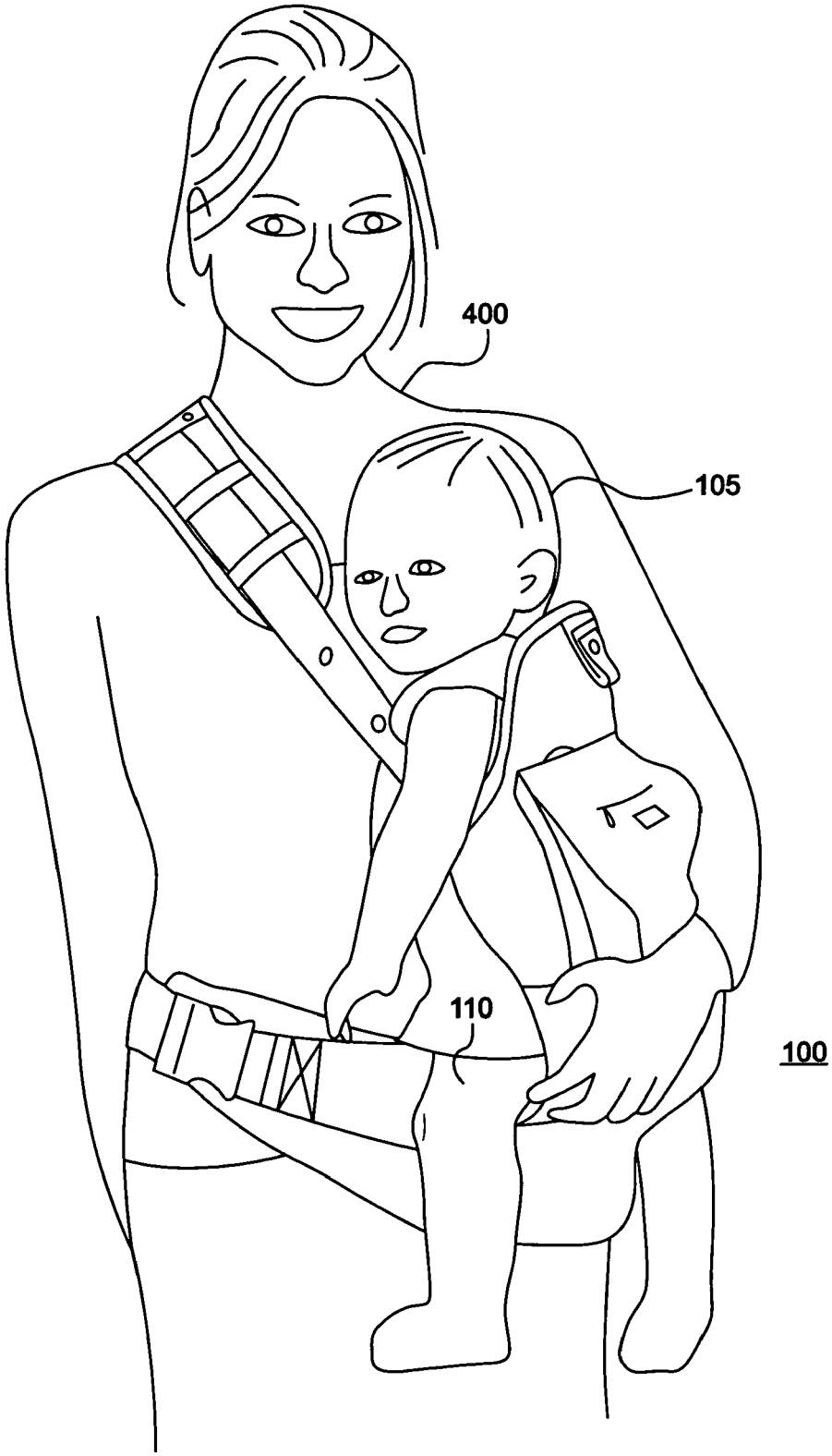
FIG. 7 is a drawing of the child carrier of FIG. 1 with the child carried on the hip of the transporting individual, with the child facing the transporting individual, and with the child's upper legs (thighs) unsupported.

FIG. 7 is a drawing of the child carrier 100 of FIG. 1 with the child 105 carried on the hip of the transporting individual 400, with the child 105 facing the transporting individual 400, and with the child's upper legs (thighs) 110 unsupported. As in FIG. 6, the first fastener 171 of FIG. 7 is coupled to the third fastener 173. The first fastener 171 could be a male type fastening device with the third fastener 173 being a female type fastening device, or the first fastener 171 could be a female type fastening device with the third fastener 173 being a male type fastening device. The left and the right shoulder straps 125,130 can be adjusted in length as appropriate.

Figure 8:
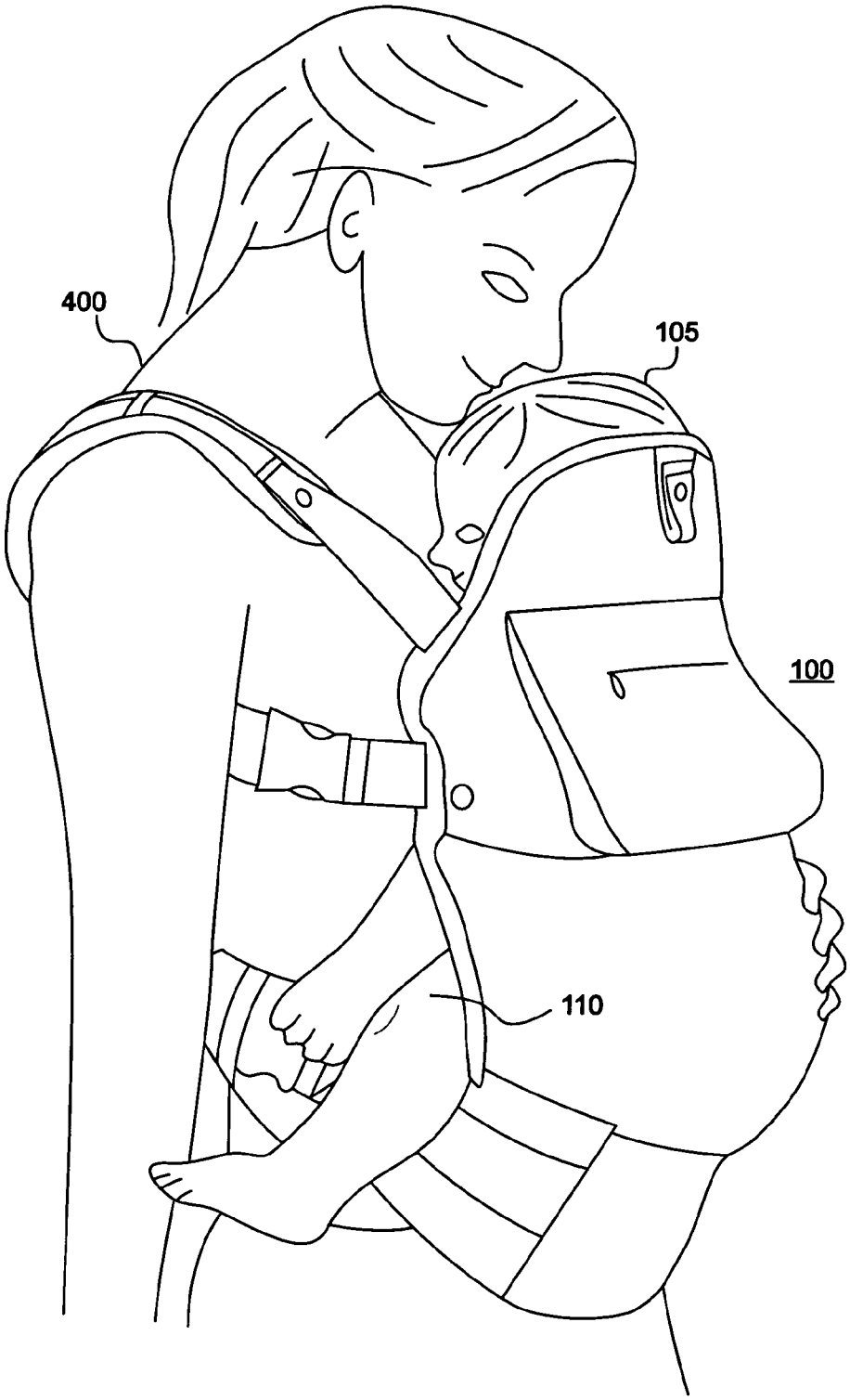
FIG. 8 is a drawing of the child carrier of FIG. 1 with the child carried in front of the transporting individual, with the child facing the transporting individual, and with the child's upper legs (thighs) supported.

FIG. 8 is a drawing of the child carrier 100 of FIG. 1 with the child 105 carried in front of the transporting individual 400, with the child 105 facing the transporting individual 400, and with the child's upper legs (thighs) 110 supported.

Figure 9:
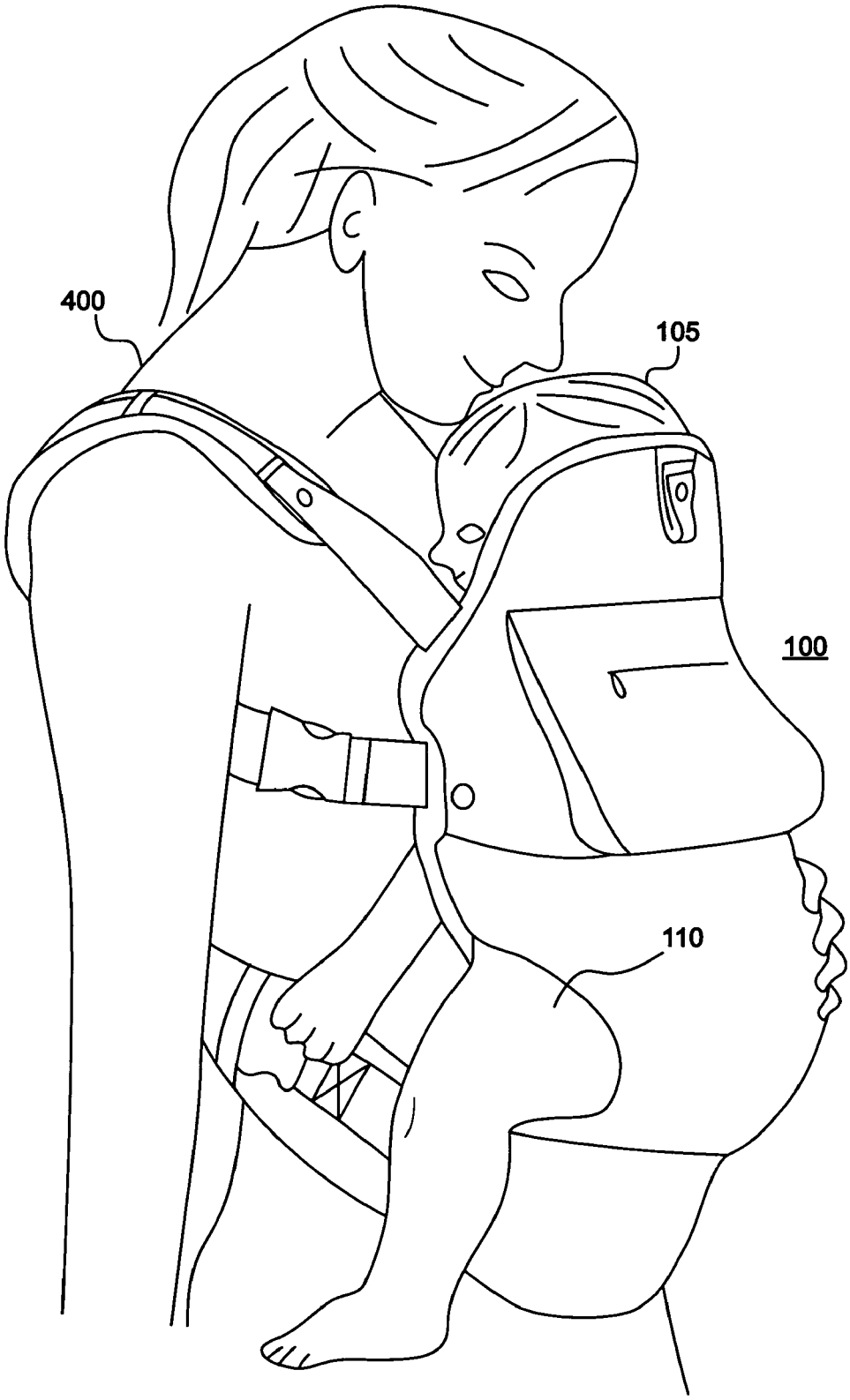
FIG. 9 is a drawing of the child carrier of FIG. 1 with the child carried in front of the transporting individual, with the child facing the transporting individual, and with the child's upper legs (thighs) unsupported.

FIG. 9 is a drawing of the child carrier 100 of FIG. 1 with the child 105 carried in front of the transporting individual 400, with the child 105 facing the transporting individual 400, and with the child's upper legs (thighs) 110 unsupported.

Figure 10:
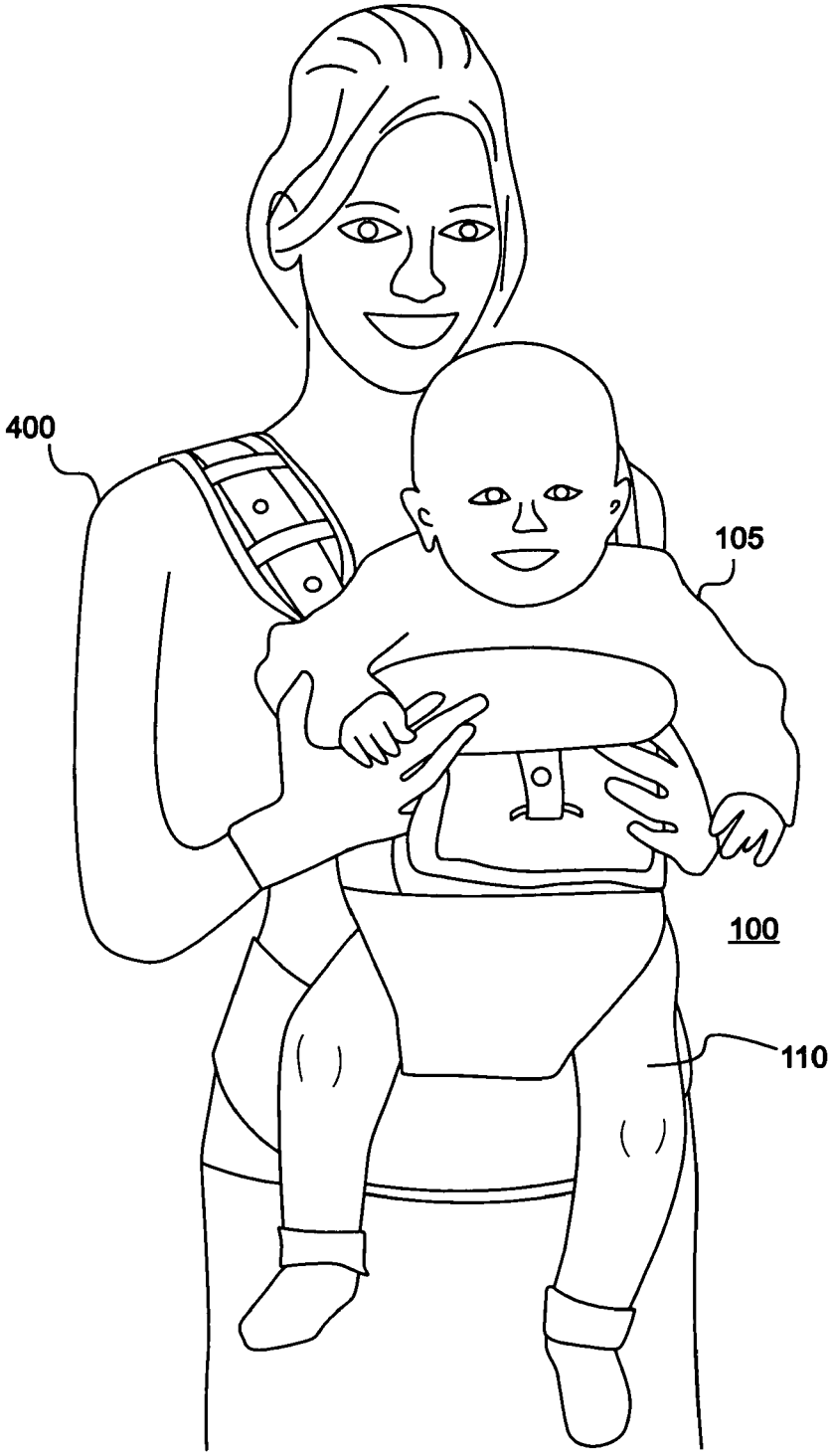
FIG. 10 is a drawing of the child carrier of FIG. 1 with the child carried in front of the transporting individual, with the child facing away from the transporting individual, and with the child's upper legs (thighs) unsupported.

FIG. 10 is a drawing of the child carrier 100 of FIG. 1 with the child 105 carried in front of the transporting individual 400, with the child 105 facing away from the transporting individual 400, and with the child's upper legs (thighs) 110 unsupported.

Figure 11:
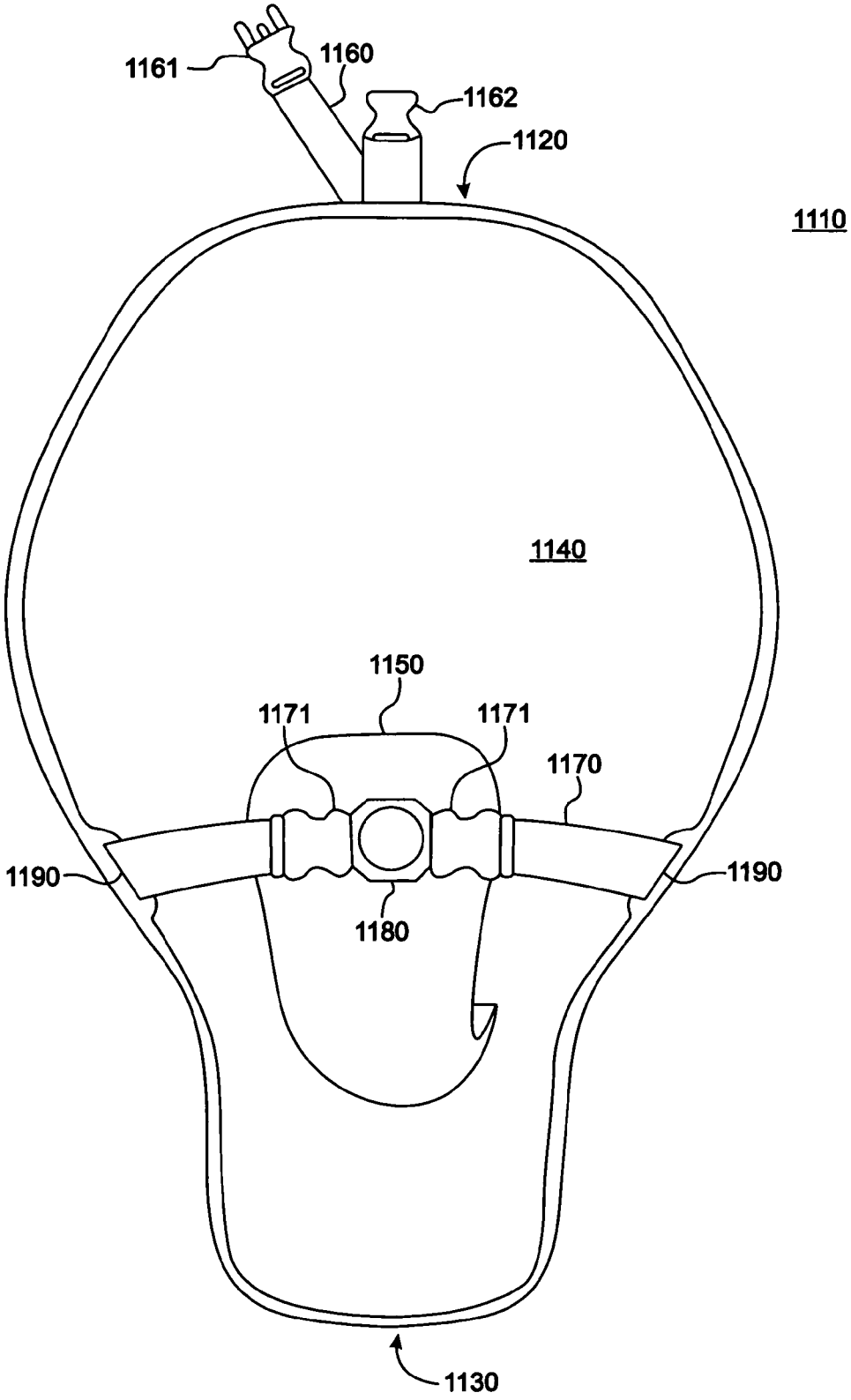
FIG. 11 is a drawing of a front view of a cradle insert as described in various representative embodiments.

FIG. 11 is a drawing of a front view of a cradle insert 1110 as described in various representative embodiments. The cradle insert 1110 can be used with the child carrier 100 to transport a younger child 105, such as an infant, in a reclining position. The cradle insert 1110 has a head end 1120 and a foot end 1130 and comprises a pad 1140, a crotch support 1150 coupled to the pad 1140, a first attachment strap 1160 coupled to the pad 1140, a second attachment strap 1170 coupled to the pad 1140, and a strap receptacle 1180 coupled to the crotch support 1150. Affixed to the ends of the first attachment strap 1160 are a first and a second clasps 1161, 1162 which are attachable to each other. With the crotch support 1150 placed between the child's 105 legs, the cradle insert 1110 can be secured to the child 105 by coupling each of the two second-attachment-strap ends 1171 of the second attachment strap 1170 to the strap receptacle 1180. The second attachment strap 1170 is held in place by passing it around the pad 1140 and through holes 1190.

Figure 12:
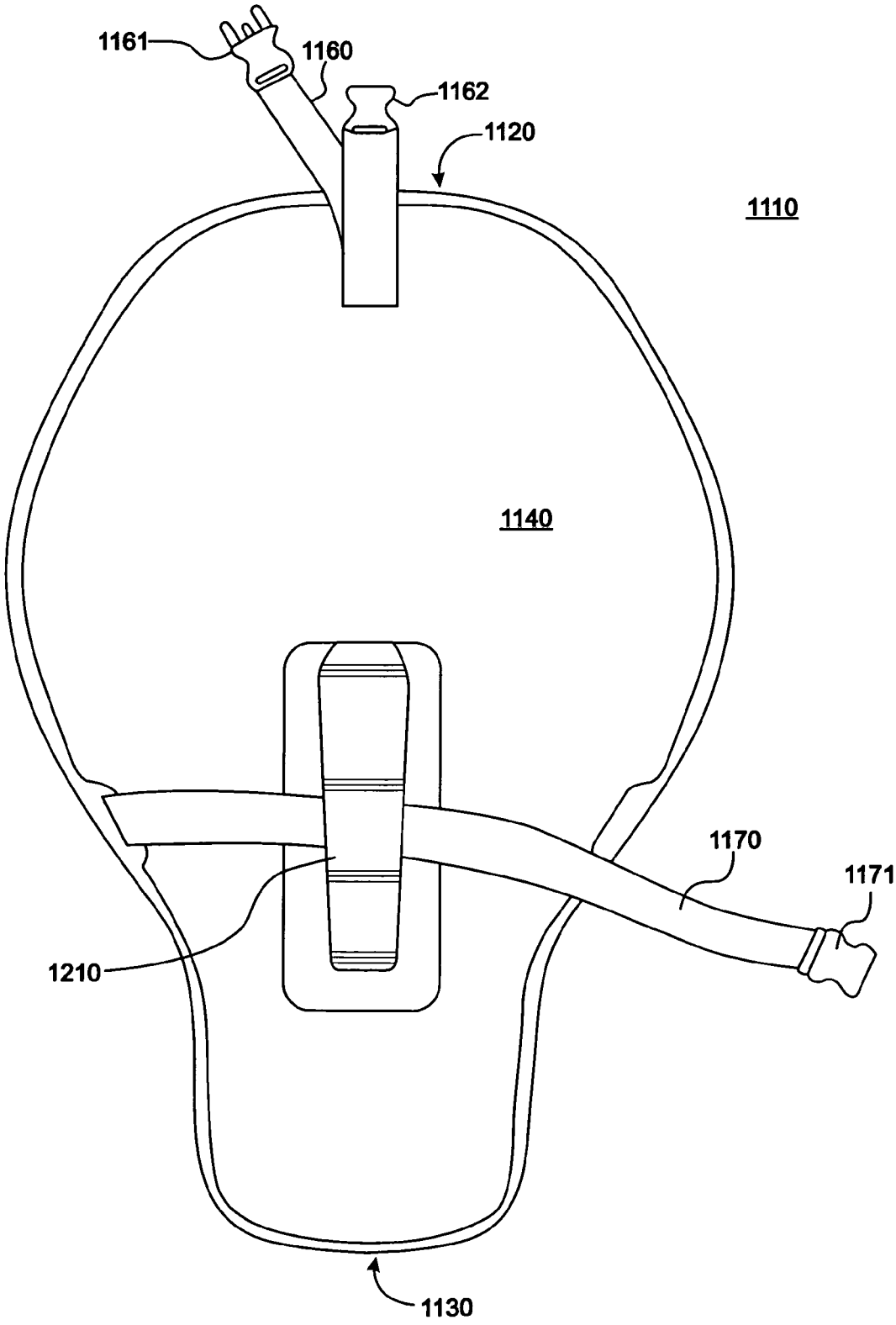
FIG. 12 is a drawing of a back view of the cradle insert of FIG. 11.

FIG. 12 is a drawing of a back view of the cradle insert 1110 of FIG. 11. In FIG. 12, the second attachment strap 1170 is shown coupled to an attachment loop 1210 by passing the second attachment strap 1170 through the attachment loop 1210. In other representative embodiments, various other devices could be used for securing the child 105 to the pad 1140.

Figure 13:
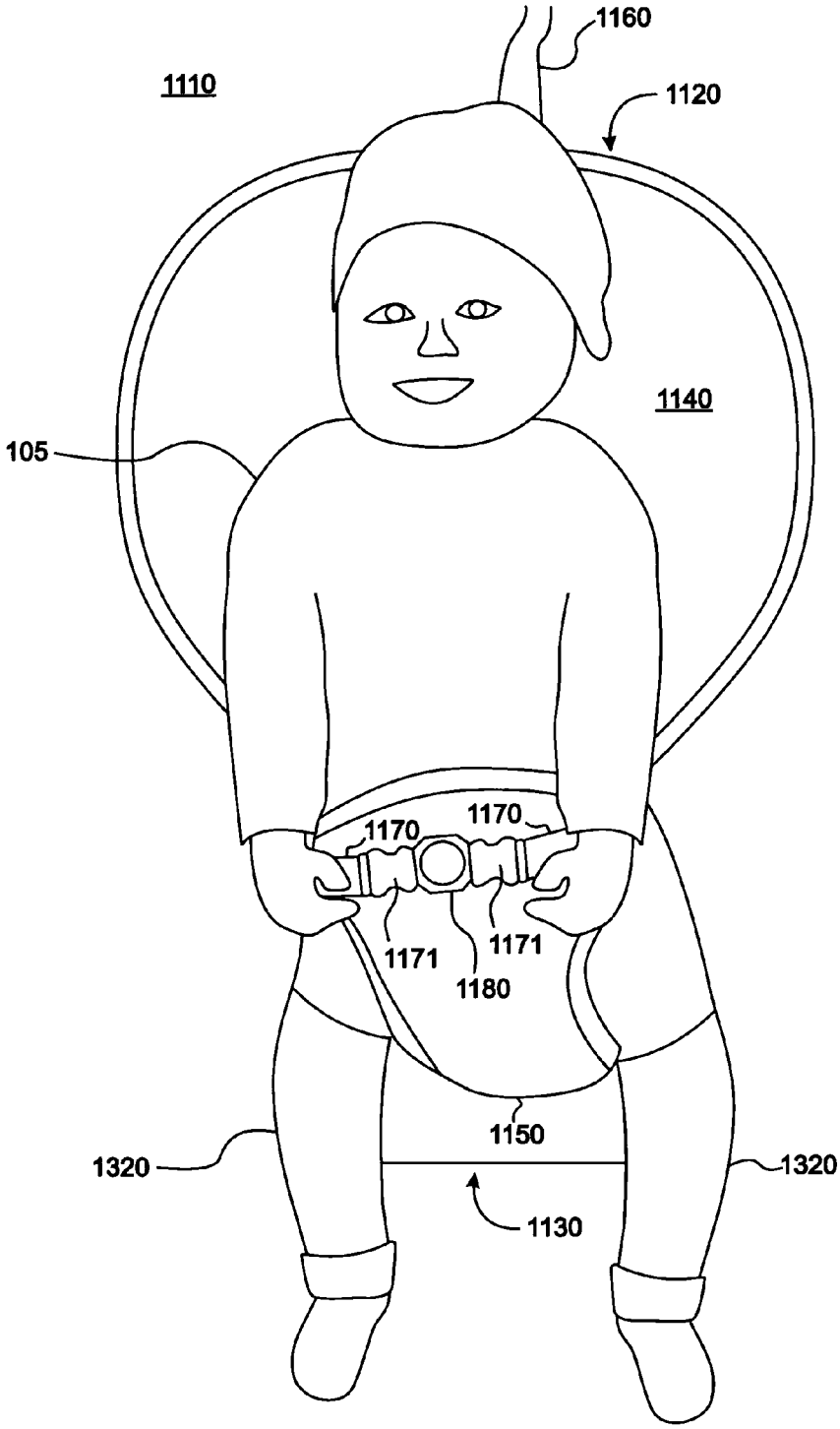
FIG. 13 is a drawing of a child placed in the cradle insert of FIG. 11.

FIG. 13 is a drawing of a child 105 placed in the cradle insert 1110 of FIG. 11. FIG. 13 shows the crotch support 1150 placed between the child's 105 legs 1320. The cradle insert 1110 is secured to the child 105 by coupling each of the two second-attachment-strap ends 1171 of the second attachment strap 1170 to the strap receptacle 1180 coupled to the crotch support 1150. As stated above, the second attachment strap 1170 is held in place by passing it around the pad 1140 and through holes 1190. The cradle insert 1110 can be secured to the child carrier 100 by encircling one of the shoulder straps 125,130 with the first attachment strap 1160 and coupling the first clasp 1161 to the second clasp 1162. An additional attachment device (not shown in the figures) can be disposed on the inside of the child carrier 100 for coupling with the attachment loop 1210 on the cradle insert 1110. This additional attachment device on the child carrier 100 along with the paired attachment loop 1210 on the cradle insert 1110 provide a second coupling mechanism and, thus, enable more secure coupling of the cradle insert 1110 to the child carrier 100.

Figure 14:
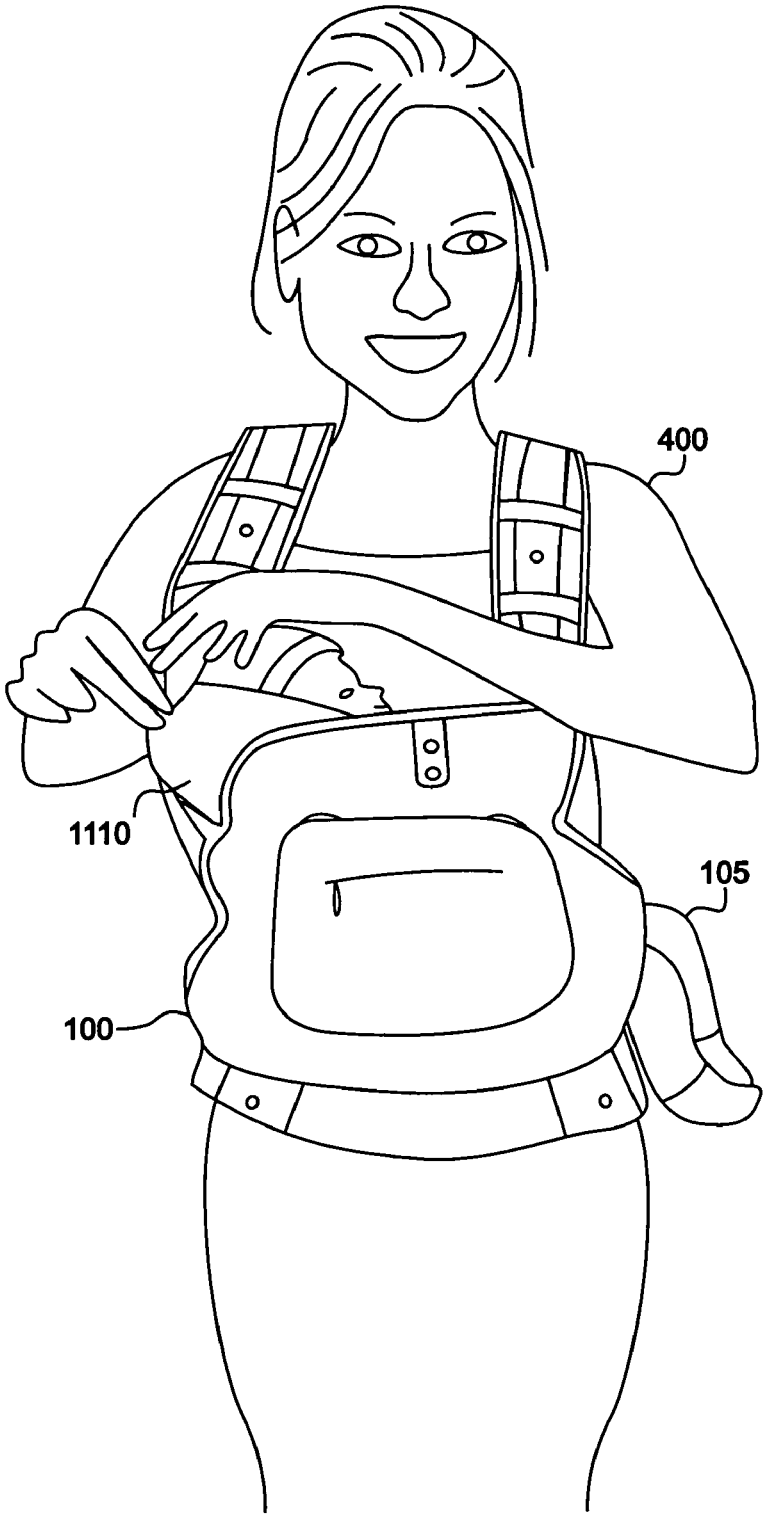
FIG. 14 is a drawing of the child carrier of FIG. 1 with the child carried in the cradle insert in a reclining position in front of the transporting individual.

FIG. 14 is a drawing of the child carrier 100 of FIG. 1 with the child 105 carried in the cradle insert 1110 in a reclining position in front of the transporting individual 400. In FIG. 14, the transporting individual 400 is shown carrying the child 105 using the cradle insert 1110 in the child carrier 100. The child 105 is in a reclining position within the cradle insert 1110.

The seat support part 120 of the child carrier 100 can be formed having a general cup shape conforming to the general shape of the child's 105 posterior thereby providing more comfortable support. If the left upper-leg-support part 145-L is coupled to the left side of the hip belt 140 and the right upper-leg-support part 145-R is coupled to the right side of the hip belt 140, the carrier 100 is configured for supporting the child 105 in an ergonomic sitting position wherein the thighs 110 of the child 105 are supported proximately perpendicular to the child's 105 body 165 with that part of the child's 105 legs below his/her knees hanging downward. Alternately, if the left upper-leg-support part 145-L is decoupled from the left side of the hip belt 140 and the right upper-leg-support part 145-R is decoupled from the right side of the hip belt 140, the carrier 100 is configured such that the seat support part 120 converts to a narrower seat area thereby enabling the thighs 110 of the child 105 to hang proximately parallel to the body 165 of the child 105. This configuration can be used for a younger child 105 that is not large enough for his/her legs to wrap around the transporting individual 400 which could be, for example, a parent or other person sufficiently strong to carry the child 105 in the child carrier 100. Depending upon the situation, the various carrying configurations of the child carrier 100 enable the transporting individual 400 to select the most appropriate configuration for carrying the child 105, i.e., with the child 105 carried on the back, the hip, or the front of the transporting individual 400, with the child facing away from or toward the transporting individual 400, and with the child 105 in the sitting or hanging position as appropriate. One or another configuration may suit a particular child 105 and/or transporting individual 400 better than the others. For example, a younger child 105 may find it more comforting to be carried on the front of the transporting individual 400 and be more comfortable with his/her thighs 110 hanging proximately parallel to the child's 105 body 165. For a sleeping infant, carrying the child 105 on the front of the transporting individual 400 in the cradle insert 1110 may be the most comfortable for the child 105. However, for carrying an older and therefore larger child 105, carrying the child 105 on the back or hip of the transporting individual 400 and be more comfortable. To reduce fatigue, the transporting individual 400 may choose to switch between configurations.

Appropriate attachment of the two shoulder straps 125,130 enables transporting the child 105 on the front, on the back, or on the hip of the transporting individual 400. The coupling of the seat support part 120 to the hip belt 140 helps absorb the movement and weight of the child 105, eases the strain on the back of the transporting individual 400, and provides a smoother ride for both the transporting individual 400 and the child 105.

In various representative embodiments, removable shoulder pads and/or interchangeable shoulder pads can be used with the shoulder straps 125,130. Such shoulder pads could be filled with a gel to enhance the comfort of the transporting individual 400. Other elements such as pockets to hide buckles when the carrier 100 is used as a one-carrying-strap hip carrier, expandable pockets, and/or a removable hood for the child 105 could be used to add to the functionality of the carrier 100.

In a representative embodiment, the cradle insert 1110 enables the carrier 100 to be used with infants such as a newborn child 105 since a newborn child should always be carried in a horizontal position to reduce strain on the infant's back. Using the cradle insert 1110 as a part of the carrier 100 can be used to extend the useful life of the carrier 100 for a given child 105.

The hip belt 140 of the carrier 100 can be padded and can enable carrying the child 105 on the front, the back, or the hip of the transporting individual 400. With the child 105 sitting in the carrier 100 and the left and right upper-leg-support parts 145-L,145-R coupled to the hip belt 140, the upper part of the legs 110 form a proximate 90 degrees angle to the hip of the child 105 and also form a proximate 90 degrees angle to the lower legs of the child 105 at the child's knees. This position is a more natural sitting position for the child 105 than the position in which the child's legs are hanging straighter and down proximate parallel to the vertical. However, the child 105 can also be carried with his/her legs hanging straighter and down. In this mode, the left and right upper-leg-support parts 145-L,145-R can be removed, folded inward toward the seat support part 120, or allowed to hang loose.

Pockets can be added to the carrier 100 for storing the second and the fourth fasteners 172,174 when they are not otherwise coupled to other items. Various other pockets can also be added for carrying miscellaneous items, and a removable or permanent hood can be added for protecting the child's head.

In representative embodiments, child carriers 100 are disclosed herein that enable carrying the child 105 in various positions including on the back, on the hip, or in front of an individual 400. In various configurations, the upper legs 110 or thighs 110 of the child 105 can be supported proximately perpendicular to the body 165 of the child 105. And in other configurations, the thighs 110 of the child 105 can hang proximately parallel to the body 165 of the child 105. Dependent upon the size and weight of the child 105, the individual 400 may find it more comfortable to carry the child 105 in one of these configurations than in the others and/or the child 105 may be more comfortable in one of these configurations than in the others.

The multiple options both for the transporting individual 400 and the multiple options for the child's 105 sitting/hanging positions provide for a long useful lifespan of a given implementation of the carrier 100 since the carrying position can be adjusted to the most comfortable and ergonomic carrying position depending upon the child's 105 weight and age. The transporting individual 400 can choose their own preferred configuration for carrying the child 105 and, if desired, alternate or change carrying positions/configurations at any time dependent upon the situation. Children 105, from a newborn child 105 up to a heavy child 105, can be carried by a transporting individual 400 limited only by the strength of the transporting individual 400.

The configuration needs for a carrier 100 can also change depending upon the situation. When hiking or walking the transporting individual 400 may prefer to carry the child 105 on his or her back. But, when in a crowded area such as a store or on a city street, the transporting individual 400 may prefer to carry the child 105 on his/her hip or in front to have more control over the child's 105 activities. If the child 105 is tired, a position supporting sleeping, such as a horizontal position or facing the transporting individual 400 may be preferred. If the child 105 is alert, facing the child 105 forward away from the transporting individual 400 may be the preferred configuration as this configuration could allow the child 105 to look around without the child 105 twisting his/her neck.

In a representative embodiment, a carrier 100 for transporting a child 105 by a transporting individual 400 is disclosed. The carrier 100 comprises a torso support part 115 configured for supporting the torso of the child 105, a seat support part 120 coupled to the torso support part 115, and at least one strap 125,130 coupled to the torso support part 115 and/or to the seat support part 120 and with the torso support part 115 and the seat support part 120 configured to encircle at least part of the torso of the transporting individual 400. The seat support part 120 is configured for supporting the posterior of the child 105 in a sitting position in a first configuration, and the seat support part 120 is configured for supporting the posterior of the child 105 in a hanging position in a second configuration.

In another representative embodiment, a carrier 100 for transporting a child 105 is disclosed. The carrier 100 comprises a torso support part 115 configured for supporting the torso of the child 105, a left shoulder strap 125 having an upper and a lower left-strap ends 126,127 configured for coupling to the torso support part 115 at respectively an upper left coupling point 128 and a lower left coupling point 129 on the torso support part 115, a right shoulder strap 130 having an upper and a lower right-strap ends 131,132 configured for coupling to the torso support part 115 at respectively an upper right coupling point 133 and a lower right coupling point 134 on the torso support part 115, a seat support part 120 coupled to the torso support part 115 and configured for supporting the posterior of the child 105, and a hip belt 140 coupled to the seat support part 120. The torso support part 115 includes a left upper-leg-support part 145-L disposed on the left side of the seat support part 120 and a right upper-leg-support part 145-R disposed on the right side of the seat support part 120; the left upper-leg-support part 145-L is further configured for coupling to the left side of the hip belt 140; the right upper-leg-support part 145-R is further configured for coupling to the right side of the hip belt 140; if the left upper-leg-support part 145-L is coupled to the left side of the hip belt 140 and the right upper-leg-support part 145-R is coupled to the right side of the hip belt 140, the carrier 100 is configured for supporting the thighs 110 of the child 105 proximately perpendicular to the body 165 of the child 105; and if the left upper-leg-support part 145-L is decoupled from the left side of the hip belt 140 and the right upper-leg-support part 145-R is decoupled from the right side of the hip belt 140, the carrier 100 is configured to enable the thighs 110 of the child 105 to hang proximately parallel to the body 165 of the child 105.

The representative embodiments, which have been described in detail herein, have been presented by way of example and not by way of limitation. It will be understood by those skilled in the art that various changes may be made in the form and details of the described embodiments resulting in equivalent embodiments that remain within the scope of the appended claims.

What is claimed is:

1. A carrier for transporting a child by a transporting individual, comprising:

a torso support part configured to support the torso of the child placed in the carrier;

a left shoulder strap having an upper and a lower left-strap ends configured for coupling to the torso support part at respectively an upper left coupling point and a lower left coupling point on the torso support part;

a right shoulder strap having an upper and a lower right-strap ends configured for coupling to the torso support part at respectively an upper right coupling point and a lower right coupling point on the torso support part;

a seat support part coupled to the torso support part and configured to support the posterior of the child, wherein the seat support part comprises a left upper-leg-support part disposed on the left side of the seat support part and configurable to optionally support at least part of the left thigh of the child and otherwise not support the left thigh of the child and a right upper-leg-support part disposed on the right side of the seat support part and configurable to optionally support at least part of the right thigh of the child and otherwise not support the right thigh of the child; and a hip belt coupled to the seat support part and configured for securing about the hips of the transporting individual, wherein at least one of the upper leg-support parts is coupled to the hip belt by a fastening device selected from the group consisting of mating areas of a hook and loop type fastener on that upper-leg-support part and the hip belt and mating snaps on that upper-leg-support part and the hip belt.

2. The carrier as recited in claim 1, further comprising:

a first fastener coupled to the left shoulder strap proximate the lower left-strap end;

a second fastener coupled to the torso support part proximate the lower left coupling point, wherein the first fastener is configured for coupling to the second fastener;

a third fastener coupled to the right shoulder strap proximate the lower right-strap end; and a fourth fastener coupled to the torso support part proximate the lower right coupling point, wherein the third fastener is configured for coupling to the fourth fastener.

3. The carrier as recited in claim 2, wherein the first fastener is a male type fastening device, the second fastener is a female type fastening device, the third fastener a female type fastening device, and the fourth fastener is a male type fastening device or wherein the first fastener is a female type fastening device, the second fastener is a male type fastening device, the third fastener a male type fastening device, and the fourth fastener is a female type fastening device.

4. The carrier as recited in claim 2, wherein the first fastener is configured to enable coupling to the third fastener.

5. The carrier as recited in claim 1, wherein the carrier is configurable to enable carrying the child in one of at least two of the following positions: on the back, on the hip, or on the front of the transporting individual.

6. The carrier as recited in claim 5, wherein if the carrier is configured for carrying the child on the back of the transporting individual, the carrier is further configurable for carrying the child facing toward the transporting individual, wherein if the carrier is configured for carrying the child on the hip of the transporting individual, the carrier is further configurable for carrying the child facing toward the transporting individual, and wherein if the carrier is configured for carrying the child on the front of the transporting individual, the carrier is further configurable for carrying the child either facing toward the transporting individual or facing away from the transporting individual.

7. The carrier as recited in claim 1, wherein at least one of the upper leg-support parts comprises a sleeve and wherein the at least one of the upper leg-support parts can be coupled to the hip belt by passing a portion of the hip belt through the sleeve opening providing, thereby, at least partial support for one of the thighs of the child.

8. The carrier as recited in claim 1, further comprising:

a cradle insert configured for removably coupling to the carrier and configured for carrying the child in a reclining position when coupled to the carrier.

9. A carrier for transporting a child by a transporting individual, comprising:

a torso support part configured to support the torso of the child placed in the carrier;

a left shoulder strap having an upper and a lower left-strap ends configured for coupling to the torso support part at respectively an upper left coupling point and a lower left coupling point on the torso support part;

a right shoulder strap having an upper and a lower right-strap ends configured for coupling to the torso support part at respectively an upper right coupling point and a lower right coupling point on the torso support part;

a seat support part coupled to the torso support part and configured to support the posterior of the child, wherein the seat support part comprises a left upper-leg-support part disposed on the left side of the seat support part and configurable to optionally support at least part of the left thigh of the child and otherwise not support the left thigh of the child and a right upper-leg-support part disposed on the right side of the seat support part and configurable to optionally support at least part of the right thigh of the child and otherwise not support the right thigh of the child; and a hip belt coupled to the seat support part and configured for securing about the hips of the transporting individual, wherein if one of the upper-leg-support parts is decoupled from the hip belt, that upper-leg-support part is configured such that it is foldable against the seat support part and/or against the torso support part.

10. The carrier as recited in claim 9, wherein if one of the upper-leg-support parts is decoupled from the hip belt and folded against the seat support part and/or against the torso support part, that upper-leg-support part is securable to the seat support part or to the torso support part.

11. The carrier as recited in claim 9, further comprising:

a first fastener coupled to the left shoulder strap proximate the lower left-strap end;

a second fastener coupled to the torso support part proximate the lower left coupling point, wherein the first fastener is configured for coupling to the second fastener;

a third fastener coupled to the right shoulder strap proximate the lower right-strap end; and a fourth fastener coupled to the torso support part proximate the lower right coupling point, wherein the third fastener is configured for coupling to the fourth fastener.

12. The carrier as recited in claim 11, wherein the first fastener is a male type fastening device, the second fastener is a female type fastening device, the third fastener a female type fastening device, and the fourth fastener is a male type fastening device or wherein the first fastener is a female type fastening device, the second fastener is a male type fastening device, the third fastener a male type fastening device, and the fourth fastener is a female type fastening device.

13. The carrier as recited in claim 11, wherein the first fastener is configured to enable coupling to the third fastener.

14. The carrier as recited in claim 9, wherein the carrier is configurable to enable carrying the child in one of at least two of the following positions: on the back, on the hip, or on the front of the transporting individual.

15. The carrier as recited in claim 14, wherein if the carrier is configured for carrying the child on the back of the transporting individual, the carrier is further configurable for carrying the child facing toward the transporting individual, wherein if the carrier is configured for carrying the child on the hip of the transporting individual, the carrier is further configurable for carrying the child facing toward the transporting individual, and wherein if the carrier is configured for carrying the child on the front of the transporting individual, the carrier is further configurable for carrying the child either facing toward the transporting individual or facing away from the transporting individual.

16. The carrier as recited in claim 9, wherein at least one of the upper leg-support parts comprises a sleeve and wherein the at least one of the upper leg-support parts can be coupled to the hip belt by passing a portion of the hip belt through the sleeve opening providing, thereby, at least partial support for one of the thighs of the child.

17. The carrier as recited in claim 9, further comprising:

a cradle insert configured for removably coupling to the carrier and configured for carrying the child in a reclining position when coupled to the carrier.

18. A carrier for transporting a child by a transporting individual, comprising:

a torso support part configured to support the torso of the child placed in the carrier;

a left shoulder strap having an upper and a lower left-strap ends configured for coupling to the torso support part at respectively an upper left coupling point and a lower left coupling point on the torso support part;

a right shoulder strap having an upper and a lower right-strap ends configured for coupling to the torso support part at respectively an upper right coupling point and a lower right coupling point on the torso support part;

a seat support part coupled to the torso support part and configured to support the posterior of the child, wherein the seat support part comprises a left upper-leg-support part disposed on the left side of the seat support part and configurable to optionally support at least part of the left thigh of the child and otherwise not support the left thigh of the child and a right upper-leg-support part disposed on the right side of the seat support part and configurable to optionally support at least part of the right thigh of the child and otherwise not support the right thigh of the child; and a hip belt coupled to the seat support part and configured for securing about the hips of the transporting individual, wherein the left upper-leg-support part is further configured for coupling to the left side of the hip belt, wherein the right upper-leg-support part is further configured for coupling to the right side of the hip belt.

19. The carrier as recited in claim 18, wherein if the left upper-leg-support part is coupled to the left side of the hip belt and the right upper-leg-support part is coupled to the right side of the hip belt, the left upper-leg-support part and the right upper-leg-support part are configured for supporting the child's thighs proximately perpendicular to the child's body, and wherein if the left upper-leg-support part is decoupled from the left side of the hip belt and the right upper-leg-support part is decoupled from the right side of the hip belt, the left upper-leg-support part and the right upper-leg-support part are configured to enable the child's thighs to hang proximately parallel to the child's body.

20. The carrier as recited in claim 18, further comprising:

a first fastener coupled to the left shoulder strap proximate the lower left-strap end;

a second fastener coupled to the torso support part proximate the lower left coupling point, wherein the first fastener is configured for coupling to the second fastener;

a third fastener coupled to the right shoulder strap proximate the lower right-strap end; and a fourth fastener coupled to the torso support part proximate the lower right coupling point, wherein the third fastener is configured for coupling to the fourth fastener.

21. The carrier as recited in claim 20, wherein the first fastener is a male type fastening device, the second fastener is a female type fastening device, the third fastener a female type fastening device, and the fourth fastener is a male type fastening device or wherein the first fastener is a female type fastening device, the second fastener is a male type fastening device, the third fastener a male type fastening device, and the fourth fastener is a female type fastening device.

22. The carrier as recited in claim 20, wherein the first fastener is configured to enable coupling to the third fastener.

23. The carrier as recited in claim 18, wherein the carrier is configurable to enable carrying the child in one of at least two of the following positions: on the back, on the hip, or on the front of the transporting individual.

24. The carrier as recited in claim 23, wherein if the carrier is configured for carrying the child on the back of the transporting individual, the carrier is further configurable for carrying the child facing toward the transporting individual, wherein if the carrier is configured for carrying the child on the hip of the transporting individual, the carrier is further configurable for carrying the child facing toward the transporting individual, and wherein if the carrier is configured for carrying the child on the front of the transporting individual, the carrier is further configurable for carrying the child either facing toward the transporting individual or facing away from the transporting individual.

25. The carrier as recited in claim 18, wherein at least one of the upper leg-support parts comprises a sleeve and wherein the at least one of the upper leg-support parts can be coupled to the hip belt by passing a portion of the hip belt through the sleeve opening providing, thereby, at least partial support for one of the thighs of the child.

26. The carrier as recited in claim 18, further comprising:

a cradle insert configured for removably coupling to the carrier and configured for carrying the child in a reclining position when coupled to the carrier.

* * * * *